US010774637B2

(12) United States Patent
Torres-Verdin et al.

(10) Patent No.: US 10,774,637 B2
(45) Date of Patent: Sep. 15, 2020

(54) SENSING FORMATION PROPERTIES DURING WELLBORE CONSTRUCTION

(71) Applicant: Board of Regents, The University of Texas System, Austin, TX (US)

(72) Inventors: Carlos Torres-Verdin, Austin, TX (US); Roman Shor, Austin, TX (US); Eric van Oort, Bee Cave, TX (US)

(73) Assignee: Board of Regents, The University of Texas System, Austin, TX (US)

( * ) Notice: Subject to any disclaimer, the term of this patent is extended or adjusted under 35 U.S.C. 154(b) by 232 days.

(21) Appl. No.: 15/793,549

(22) Filed: Oct. 25, 2017

(65) Prior Publication Data

US 2018/0128102 A1 May 10, 2018

Related U.S. Application Data

(60) Provisional application No. 62/417,622, filed on Nov. 4, 2016.

(51) Int. Cl.
*E21B 49/00* (2006.01)
*E21B 47/12* (2012.01)

(52) U.S. Cl.
CPC ..... *E21B 49/003* (2013.01); *E21B 47/12* (2013.01); *E21B 49/005* (2013.01)

(58) Field of Classification Search
CPC ..... E21B 47/12; E21B 49/003; E21B 49/006; E21B 49/005
See application file for complete search history.

(56) References Cited

U.S. PATENT DOCUMENTS

| | | | | |
|---|---|---|---|---|
| 4,964,087 | A | 10/1990 | Widrow | |
| 5,093,811 | A | 3/1992 | Mellor et al. | |
| 6,233,524 | B1 * | 5/2001 | Harrell | E21B 7/068 702/9 |
| 9,074,467 | B2 | 7/2015 | Yang et al. | |
| 9,075,158 | B2 | 7/2015 | Geiser | |
| 2003/0168257 | A1 * | 9/2003 | Aldred | E21B 49/003 175/24 |
| 2005/0060096 | A1 * | 3/2005 | Hutchinson | E21B 44/00 702/6 |

(Continued)

OTHER PUBLICATIONS

Al-Shuker, N., Kirby, C., and Brinsdon, M. (Jan. 1, 2011). The Application of Real Time Downhole Drilling Dynamic Signatures as a Possible Early Indicator of Lithology Changes. Society of Petroleum Engineers. doi:10.2118/149056-MS.

(Continued)

*Primary Examiner* — Robert E Fuller
*Assistant Examiner* — Christopher J Sebesta
(74) *Attorney, Agent, or Firm* — Meunier Carlin & Curfman LLC

(57) ABSTRACT

Systems and methods are disclosed that provide highly accurate and controllable measurements of rock formation properties in a wellbore. The systems and methods utilize a prescribed input signal to mechanically perturb a drill string in contact with a rock formation in order to elicit a mechanical response. Based on the input signal and the mechanical response, a transfer function is computed and analyzed, wherein the analysis uses estimates of the drill string resonances to identify rock formation resonances, which are used, in turn, to determine the rock formation properties.

20 Claims, 7 Drawing Sheets

(56) References Cited

U.S. PATENT DOCUMENTS

| | | | | |
|---|---|---|---|---|
| 2009/0146836 | A1* | 6/2009 | Santoso | E21B 47/12 340/854.4 |
| 2010/0305864 | A1 | 12/2010 | Gies | |
| 2012/0123757 | A1* | 5/2012 | Ertas | E21B 45/00 703/2 |
| 2016/0194946 | A1* | 7/2016 | Dykstra | E21B 44/00 175/24 |
| 2016/0273332 | A1* | 9/2016 | Dwars | E21B 44/00 |

OTHER PUBLICATIONS

Esmaeili, A., Elahifar, B., Fruhwirth, R. K., and Thonhauser, G. (Mar. 26, 2013). Effect of Formations Compressive Strength on Drill String Vibrations. International Petroleum Technology Conference. doi:10.2523/IPTC-16985-Abstract.

Kolle, J. J. and Theimer, K. (Jan. 1, 2005). Seismic-While-Drilling Using a Swept Impulse Source. Society of Petroleum Engineers. doi:10.2118/92114-MS.

Zhu, Y. and Brevik, I. (Oct. 29, 2014). Seismic While-Drilling Detection Using a Joint Higher-Order Correlation and Convolution Concept. Society of Exploration Geophysicists.

International Search Report and Written Opinion issued for International Application No. PCT/US2017/058937, dated Jan. 29, 2018.

* cited by examiner

SENSING FORMATION PROPERTIES DURING WELLBORE CONSTRUCTION

CROSS-REFERENCE TO RELATED APPLICATION

This application claims the benefit of U.S. Provisional Application No. 62/417,622, filed Nov. 4, 2016, which is hereby incorporated by reference in its entirety.

FIELD OF THE INVENTION

The present disclosure relates wellbore construction and more specifically to the determination of in-situ rock properties using a prescribed perturbation applied to a drill string.

BACKGROUND

Precise knowledge of the mechanical properties of rock formations during wellbore construction is of utmost importance, especially in the hydrocarbon exploration and production industry. Knowledge of formation properties may be used to improve drilling operations, to design well completions, and/or to enhance hydrocarbon production during hydro-fracturing.

Estimating a rock formation's mechanical properties may be accomplished prior to drilling, after drilling, or during drilling. One approach for sensing formation properties uses seismic data acquired away from the drill bit (e.g., at the surface of a borehole). Because this approach senses at a distance, the estimates of the formation properties may suffer from low spatial resolution and/or error. Another approach (e.g., wireline formation testing) may sense formation properties in the borehole (i.e., wellbore) after the wellbore has been drilled. This approach may offer improved accuracy because it senses in the wellbore but suffers because the stresses, pore fluids, and pressures may have been altered by the drilling process. For example, measuring formation properties in the wellbore while drilling may be accomplished using logging while drilling (LWD) or measuring while drilling (MWD) tools that are integrated with a drill string. Because the LWD/MWD tools are typically integrated with the drill string away from the drill-bit (e.g., 10-60 feet behind), the formation properties measured have already been changed as a result of the drilling. Further, LWD/MWD tools may have associated safety/regulatory issues because they generally use radioactive sources to probe a formation. Recent research has shown that it is possible to estimate formation properties at the drill-bit by sensing acoustic noise stemming from rock failure during drilling. This approach relies on drilling noise (e.g., normal vibrations associated with drilling) to excite desired mechanical harmonics from which the formation properties may be inferred. This approach is limited, however, because the drilling noise relied on for sensing and measurement is uncontrolled. For at least this reason, this approach has not been generally used for commercial drilling.

A need, therefore, exists for an apparatus, system, and method for obtaining high-resolution and reliable estimates of formation properties (i) at the drill-bit, (ii) during wellbore construction, and (iii) with improved control over the sensing and measurement.

SUMMARY

Accordingly, in one aspect, the present disclosure embraces a method for determining elastic and mechanical properties (i.e., properties) of a rock formation (i.e., formation) during the construction (i.e., drilling) of a wellbore (i.e., borehole, well). The method includes positioning a drill string in a wellbore so that the drill string's drill bit is in contact with a formation. Next, for a period, one or more operating parameters of the drill-bit are perturbed according to a prescribed input signal. Immediately following the period, an output signal, which corresponds to the drill string's mechanical response to the perturbation, is sensed. Then, using the prescribed input signal and the sensed output signal, a transfer function is computed. Finally, the transfer function is analyzed to determine the properties of the formation, wherein the analysis includes distinguishing resonances in the transfer function that result from the drill string from resonances in the transfer function that result from the formation. This is possible because the sensed output signal, which corresponds to mechanical response of the drill string, represents both the drill string's mechanical response and the formation's mechanical response to the perturbing.

In example implementations of the method, the perturbation is applied to a stationary drill-bit (i.e., perturbed from a resting state) or is applied to a drill bit that is already moving as part of a drilling operation (i.e., perturbed from a moving steady-state).

In other example implementations of the method, the one or more operating parameters of the drill-bit include a torque, a speed (i.e., revolutions per minute), a displacement (e.g., axial displacement), and/or an axial force, or some combination thereof.

In another example implementation of the method, the prescribed input signal is selected from a library of prescribed input signals. For example, the selection of input signal may be based on a desired transfer function characteristic, such as a frequency, a bandwidth, and/or a resolution of the transfer function.

In other example implementations of the method, the operations for determining formation properties (i.e., perturbing, sensing, computing, and analyzing) may be repeated during wellbore construction to determine formation properties at various points along the length of the wellbore so that the determined properties of the formation are from a plurality of positions in the wellbore. In some cases, this repetition may be manually controlled by a user, while in others it may be controlled automatically (e.g., as part of an automated drilling process or in response to an event). In some implementations, the formation properties determined at one position in the wellbore may determine the perturbation for another. For example, the selection of a prescribed input signal from a library of prescribed input signals may be based on the properties of one or more formations determined at any of a plurality of positions along the length of the wellbore.

In other example implementations, the properties of the formation may be used in subsequent operations. For example, the properties of the formation may be used for determining requirements for a stable wellbore, or for hydraulic fracturing. In addition, the determined properties may be used to model a reservoir.

In another aspect, the present disclosure embraces a drill system for wellbore construction. The drill system includes a drill string with a drill-bit that in contact with a formation in the wellbore (e.g., at the bottom of a wellbore at a bit-rock interface). The drill system also includes a motive-force source, which is coupled to the drill string and which operates the drill-bit according to operating parameters. The drill system also includes one or more sensors that are coupled to the drill string to detect a mechanical response of the drill string. The drill system also includes a computing device with a processor. The processor is in communication with the motive-force subsystem, the one or more sensors, and a memory. The memory stores computer-readable instructions that, when executed, cause the processor to perform a process for determining properties of the formation. In particular, the processor is configured to cause the motive-force source to perturb, for a period, one or more operating parameters of the drill-bit according to a prescribed input signal. Then, the processor receives an output signal from the one or more sensors immediately following the period. The received output signal corresponds to the drill string's mechanical response to the perturbation. Next, the processor computes a transfer function based on the prescribed input signal and the output signal and analyzes the transfer function to determine properties of the formation. This analysis includes distinguishing resonances in the transfer function as from the drill string or as from the formation.

In an example implementation of the drill system, the operating parameters of the drill-bit include a torque, a speed, a displacement, and/or an axial force, or some combination thereof.

In another example implementation of the drill system, the one or more sensors comprise one or more accelerometers aligned with one or more directions.

In other example implementations of the drill system, the prescribed input signal is a step signal, a chirp signal, or random-white-noise signal.

In another example implementation of the drill system, the determined properties of the formation include one or more components of a three-dimensional stiffness/compliance matrix.

In another example implementation of the drill system, the processor is further configured to change the operating parameters (e.g., for drilling) based on the determined properties of the formation.

In another example implementation of the drill system, the drill string includes one or more of the following: pipes, drill collars, drilling stabilizers, motors, measurement while drilling (MWD) tools, and/or logging while drilling (LWD) tools.

Various motive-force source configurations may be used in various implementations of the drill system. In one example implementation the motive-force source is integrated within the drill string (e.g., as a section of the drill string). In another example implementation, the motive-force source is located in the wellbore, along the drill string, at a point between the surface end of the drill string and the drill bit. In another example implementation, the motive-force source is located at a surface end of the drill string.

In another example implementation of the drill system, the operating parameters are perturbed according to a fluid flow in the drill string (e.g., by changing the flow-rate or pressure of the fluid).

In another example implementation of the drill system, the processor receives a trigger signal (or signals) that causes the processor to repeat the process for estimating one or more properties of the formation. The trigger signal may correspond to a user input, one or more of the operating parameters of the drill string, or the determined properties of the formation.

In other example implementations of the drill system, the geometry and/or trajectory of the drill string changes as the wellbore is drilled.

In another example implementation of the drill system, the determined properties of the formation include one or more components of a three-dimensional stiffness/compliance matrix.

In another aspect, the present disclosure embraces a specialized tool for a drill string. The specialized tool includes a motive-force source coupled to the drill string that operates a drill-bit of the drill string according to operating parameters. The specialized tool also includes one or more sensors coupled to the drill string, wherein the one or more sensors detect a mechanical response of the drill string. The specialized tool also includes a computing device. The computing device includes a processor in communication with the motive-force source and the one or more sensors. The processor is configured by software instructions to cause the motive-force source to perturb, for a period, one or more operating parameters of the drill-bit according to a prescribed input signal. Immediately following the period, the processor receives an output signal from the one or more sensors. The output signal corresponds to the drill string's mechanical response to the perturbation. The processor then computes a transfer function based on the prescribed input signal and the output signal and analyzes the transfer function to determine properties of the formation. The analysis includes distinguishing resonances in the transfer function as from the drill string's response to the perturbation or as from the formation's response to the perturbation.

In an example implementation of the specialized tool, the specialized tool is a component of the drill string that is located within a wellbore during construction of the wellbore.

In another example implementation of the specialized tool, the specialized tool is communicatively coupled to a second computer at the surface of the wellbore during the construction of the wellbore.

The foregoing illustrative summary, as well as other example objectives and/or advantages of the disclosure, and the manner in which the same are accomplished, are further explained within the following detailed description and its accompanying drawings.

BRIEF DESCRIPTION OF THE DRAWINGS

Figure (FIG. 1 graphically depicts an example environment of wellbore construction according to an implementation of the present disclosure.

FIGS. 5A-5D graphically depict example prescribed input signals according to implementations of the present disclosure, wherein FIG. 5A is an ideal step signal, FIG. 5B is realized step signal, FIG. 5C is a chirp signal, and FIG. 5D is a random white-noise signal.

The components in the drawings are not necessarily drawn to scale and like reference numerals designate corresponding parts throughout the figures.

DETAILED DESCRIPTION

Figure 1:
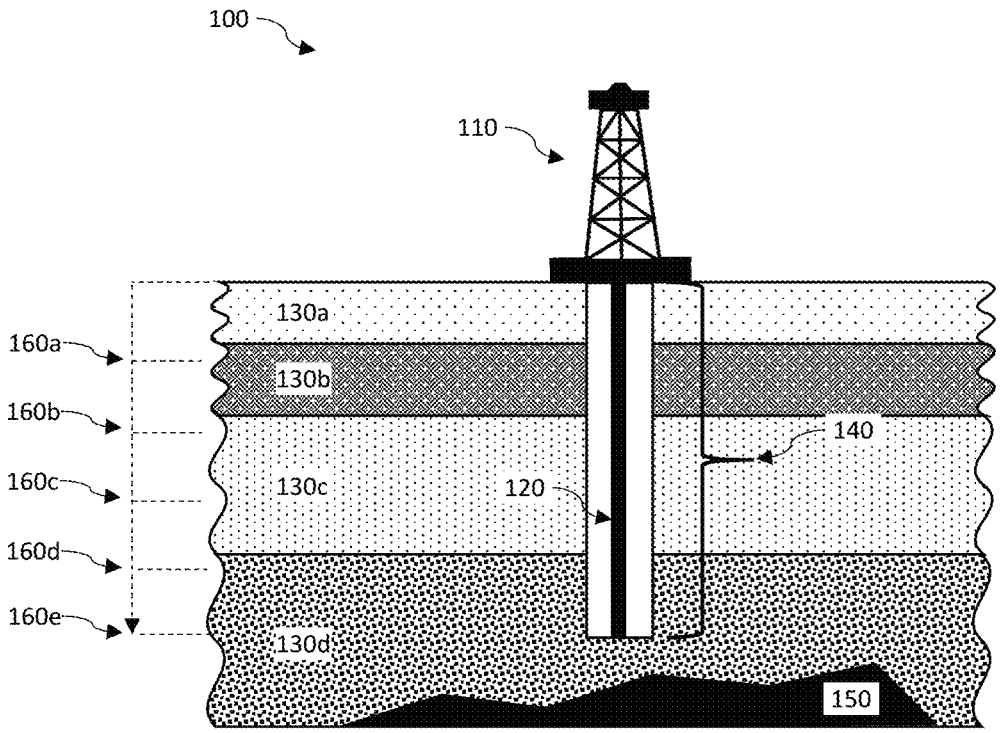

FIG. 1 graphically depicts a wellbore construction environment. The environment includes a drilling rig 110 and a drill string 120. The drilling rig 110 may include components such as mud tanks, mud pumps, a derrick (i.e., mast), draw works, a rotary table, or a top drive. The components support and empower a drill string 120 to drill rock formations 130*a*, 130*b*, 130*c*, 130*d* to form a wellbore 140. The wellbore may be constructed for a variety of purposes, such as obtaining subsurface gases or liquids (e.g., hydrocarbons) 150. FIG. 1 is for illustrative purposes, and in practice, the environment 100 is typically more complicated. For example, the drill string 120 and wellbore 140 may be non-vertical (e.g., slanted, horizontal, curved trajectory, etc.), the rock formations 130*a*, 130*b*, 130*c*, 130*d* may have complex layering, and water may separate the drilling rig 110 from the rock formations 130*a*, 130*b*, 130*c*, 130*d* (i.e., offshore drilling). The systems and methods disclosed herein may be used in any wellbore (e.g., slim well and ultra-slim well) construction environment and for any operation (e.g., mechanical, electrical, water, soil) where knowledge of rock mechanical properties are necessary to improve drilling and/or to reliably/accurately assess in-situ rock formation properties and fluid production methods.

Figure 2:
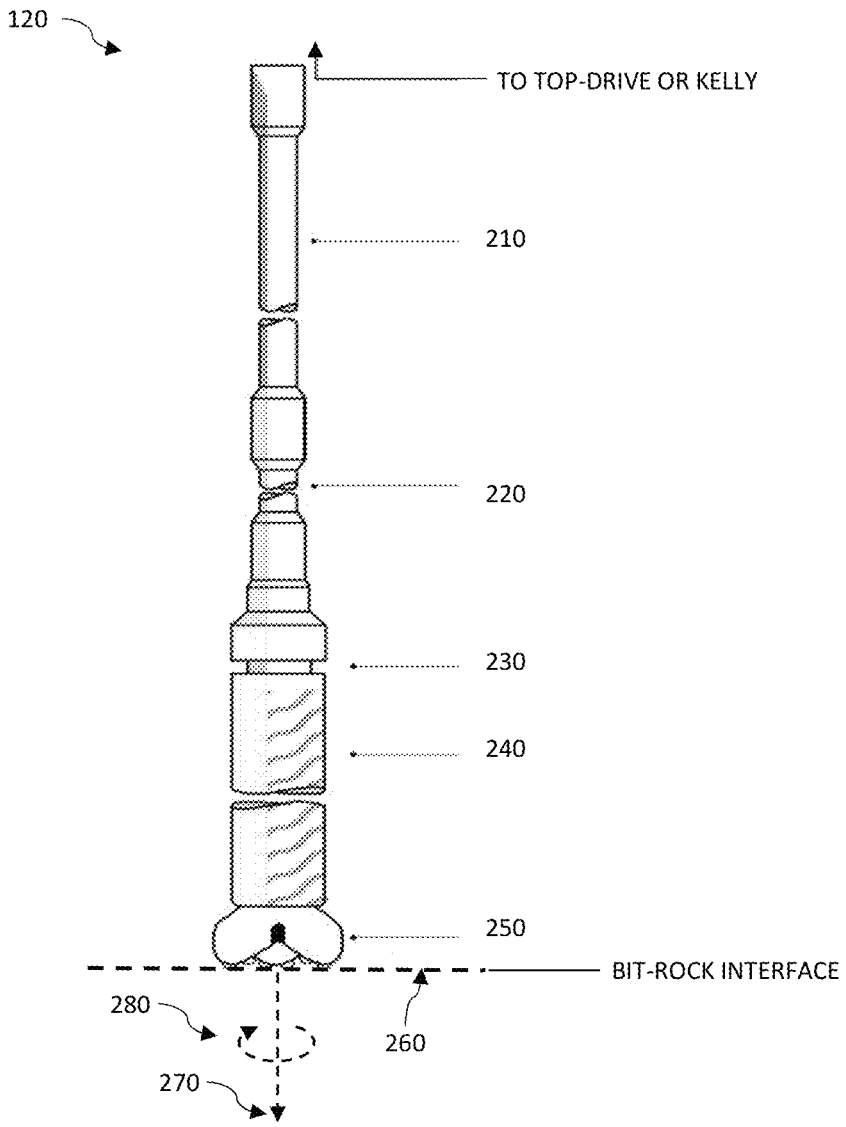
FIG. 2 graphically depicts an example drill string according to an implementation of the present disclosure.

An example of a drill string is illustrated in FIG. 2. The drill string 120 includes an assembled collection of components and/or tools that serve to drill a wellbore. In addition to the drill bit 250, which serves to crush or cut rock, various other components/tools may be included in the drill string to facilitate wellbore construction. For example, the drill string may include components such as a drill pipes 210, heavy wall drill pipes (HWDP) 220, jars 230, and drill collars 240. The drill string may also include drilling stabilizers, motors (e.g., mud motor), measurement while drilling (MWD) tools, logging while drilling (LWD) tools, and various sensors for measuring parameters including (but not limited to) torque, axial force (e.g., weight on drill-bit), speed (e.g., RPM), axial displacement (e.g., block height), and/or axial acceleration.

The components/tools are typically joined together using threaded connections and may change as the wellbore is constructed (e.g., sections added as wellbore is constructed). Each component/tool in the drill string has a particular size (e.g., length, diameter, etc.) and a particular weight. These measurements may be used to model the drill string and estimate structural resonances. The systems and methods disclosed herein may be used with a drill string composed of any combination of components/tools for which structural resonances may be reasonably estimated.

Figure 3:
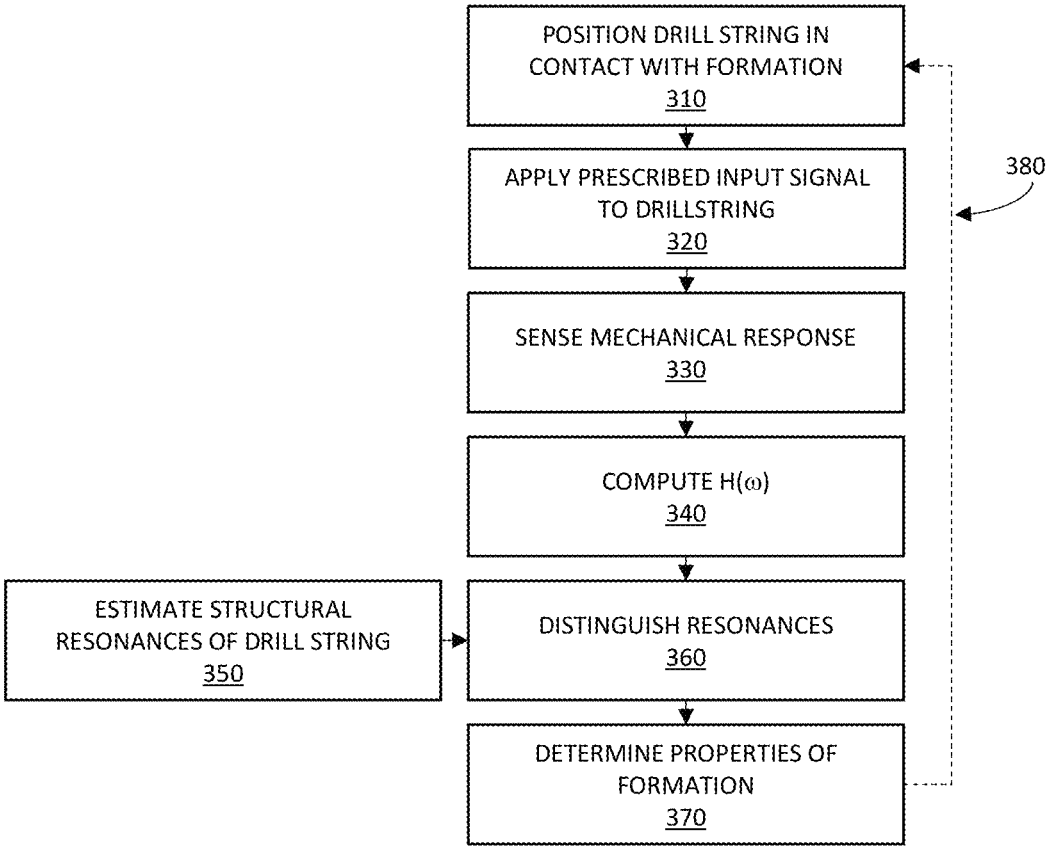
FIG. 3 is a flow diagram of an example method for determining properties of a formation according to an implementation of the present disclosure.

As mentioned previously, knowledge of rock mechanical properties at subsurface conditions is essential for efficient drilling (i.e., wellbore construction) and/or for effectively producing and stimulating the production of rock fluids. FIG. 3 depicts a flow diagram of an example method for determining formation properties according to an implementation of the present disclosure.

The first step of the method includes positioning 310 a drill string 120 so that the drill-bit 250 it is in contact with a rock formation (i.e., at the bit-rock interface 260). The drill bit may be moving or stationary. For example, the drill bit may be rotating to cut/crush the formation or may be stationary and simply touching the formation. The amount of pressure applied at the bit-rock interface 260 may vary. Sufficient pressure should be applied so that a change (i.e., perturbation) in the operating parameters (e.g., speed, torque, displacement, etc.) of the drill-bit 250 is transferred to the formation and so that the formation's response to the change is transferred to the drill string. In other words, the drill string and the formation are mechanically coupled at the bit-rock interface 260.

Next in the method, a prescribed input signal (i.e., input signal) is applied 320 to the drill string. The prescribed input signal typically acts through a motive-force source (e.g., hydraulic motor, electric motor, etc.) to induce a corresponding mechanical change in the drill string (i.e., at the drill-bit) along either an axial direction 270 or a rotational direction 280. For example, the drill-bit may experience an axial displacement or axial force corresponding to the prescribed input signal. In another example, the drill-bit may experience a rotation (e.g., change in rotational speed) or torque corresponding to the prescribed input signal. The mechanical change may result from a hydraulic motor (e.g., mud motor), driven by fluid (e.g., water) flow. In this case, the prescribed input signal may cause a change in the flow-rate or the pressure of the fluid driving the hydraulic motor.

Figure 5A:
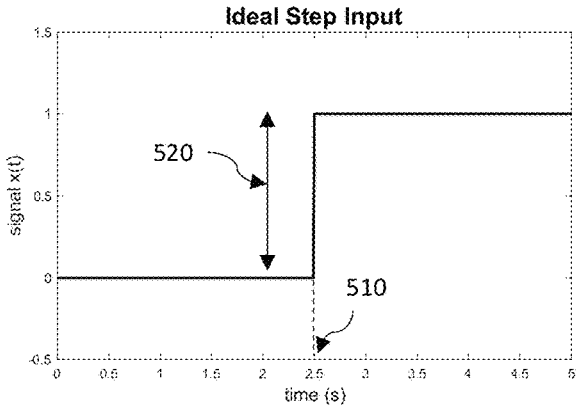
Figure 5B:
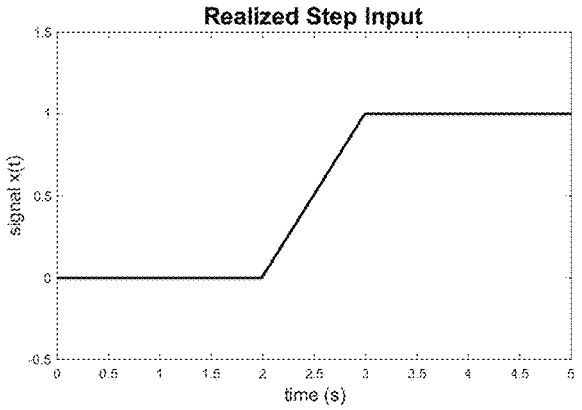
Figure 5C:
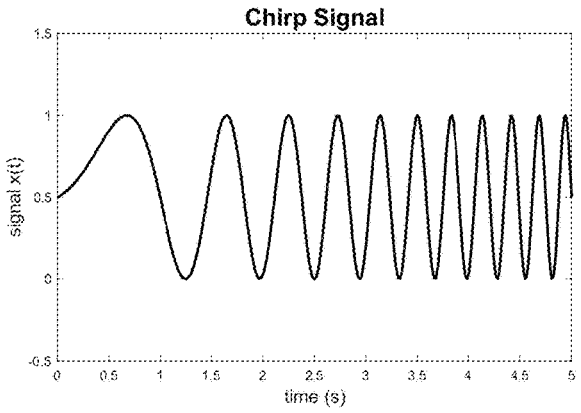
Figure 5D:
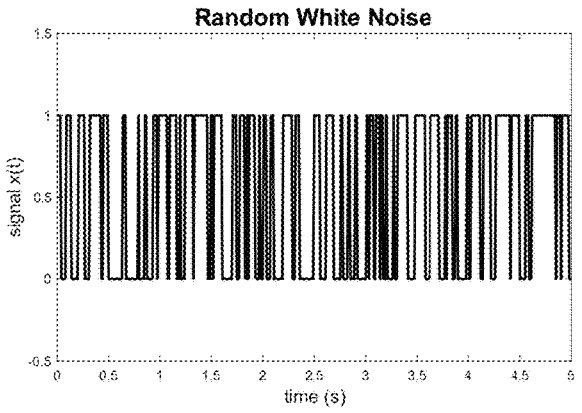

The prescribed input signal applied to the drill string is a deterministic or random signal lasting for a fixed period (i.e., time duration, perturbation period). FIGS. 5A-5D graphically depict examples of prescribed input signals that can be applied to a drill string according to implementations of the present disclosure. The input signal is applied directly or indirectly to a motive-force source to cause a corresponding change the operating parameters of the drill string. For example, the step input as shown in FIG. 5A may be used to change the displacement, force, rotational speed, or torque of the drill-bit at a particular time 510 and by an amount corresponding to the amplitude 520 of the ideal step. Likewise, other signals may be applied to the drill string. For example, a realized step (FIG. 5B), a chirp signal (FIG. 5C), or a random white noise signal (FIG. 5D) represent of non-limiting set of potential input signals that may be used.

The prescription and/or choice of input signal is one advantage of the present disclosure. An input signal may be chosen (e.g., from a library of possible input signals) for a variety of reasons. For example, an input signal may be chosen based on the formation at the bit-rock interface or based on other formations in the wellbore (e.g., previously measured formations). In another example, an input signal may be chosen based a particular drill string configuration. In another example, an input signal may be chosen based on operating characteristics of the drill string. An input signal may be selected to improve the measurement of the formation properties in a variety of ways including (but not limited to) increasing the signal to noise ratio (SNR) of the measurement and easing/improving the estimation of mechanical harmonics of the drill string.

After the prescribed input signal is applied 320 to the drill string, the method (FIG. 3) includes sensing 330 the mechanical response of the drill string. Due to the mechanical coupling described previously, the mechanical response of the drill string represents both the drill string's response and the formation's response to the change in operating parameters caused by the prescribed input signal.

Figure 4A:
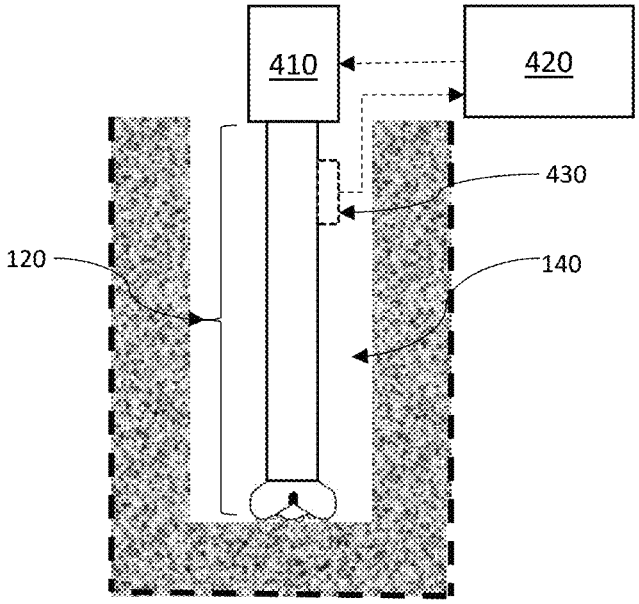
FIG. 4A graphically depicts a drill system for determining properties of a formation according to an implementation of the present disclosure.
Figure 4B:
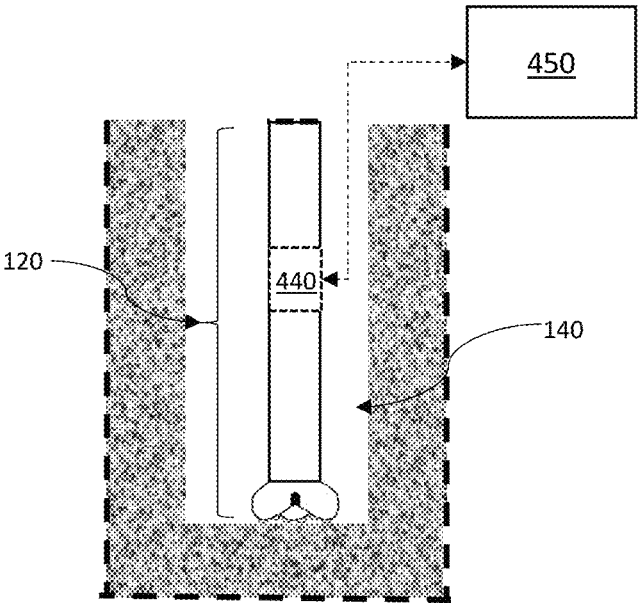
FIG. 4B graphically depicts a drill string having a specialized tool for determining properties of a formation according to an implementation of the present disclosure.

The applying 320 perturbation to, and sensing 330 a response from, the drill string may be achieved in a variety of ways and in a variety of different configurations. FIGS. 4A and 4B graphically depict relevant portions of two possible drill system implementations according to implementations of the present disclosure. As shown in FIG. 4A, a motive-force source 410 may be located at the surface of the wellbore where it is communicatively coupled (e.g., wired, wireless, etc.) with a computing device 420. The computing device 420 is also in communication with one or more sensors 430 (e.g., accelerometers) that are coupled (i.e., mechanically) to the drill string. As shown, the one or more sensors 430 (e.g., x-direction sensor, y-direction sensor, and z-direction sensor) may be coupled at any point along the length of the drill string 120 (e.g., in the wellbore 140). The (one or more) sensors 430 detect displacements and thus may be used to detect the response of the drill string to the perturbation caused by the motive-force source 410.

FIG. 4B illustrates another implementation of the drill system. Here a specialized tool 440 is integrated as one of the components/tools of the drill string 120. The specialized tool is located in the wellbore 140 (e.g., during wellbore construction) and includes the motive-source source and the one or more sensors. The specialized tool may also include the processing (e.g., a computing device) necessary for performing the operations necessary to determine the properties of the formation (e.g., at the bit-rock interface). The specialized tool may also be communicatively coupled (e.g., wired or wireless) to a second computing device 450 that may serve as a user interface, to control the specialized tool 440, store data from the specialized tool, and/or communicate with other sensors/devices in the wellbore construction environment. In some cases, the second computing device 450 may perform the operations necessary to determine the properties of the formation.

After the mechanical response of the drill string is sensed 330, the method (FIG. 3) includes computing 340 a transfer function describing the drill-string/formation system. The transfer function for a system is the ratio of the system output y(t) to the system input x(t). In the present disclosure, the input, x(t), is the prescribed input signal (e.g., a step signal, a chirp signal, etc.), while the response measured immediately after the input signal for a period is the output, y(t). In practice, x(t) and y(t) are transformed (e.g., via the fast Fourier transform) to frequency domain (i.e., X(ω) and Y(ω)), and the transfer function, H(ω), is given by the following equation:

$$H(\omega) = \frac{Y(\omega)}{X(\omega)}$$

H(ω) is measured over a frequency (ω) range (e.g., 10 Hz-100 Hz). The frequency range is typically decided by the prescribed input signal. For example, if a signal changes from $x_1$ to $x_2$ in time dt (e.g., the speed of the drill bit changes from 0 to 20 RPM in 3 seconds) the frequency bandwidth of the resulting signal then ranges from 0 to 1/dt Hertz (Hz). In this way, the selection of a prescribed input signal may result in a desired transfer function characteristic, such as frequency, bandwidth, and/or resolution. As a result, prior knowledge about the drill string and/or rock properties may warrant the use of a particular prescribed input signal in order to produce a transfer function that is most suitable for the measurement.

Figure 6:
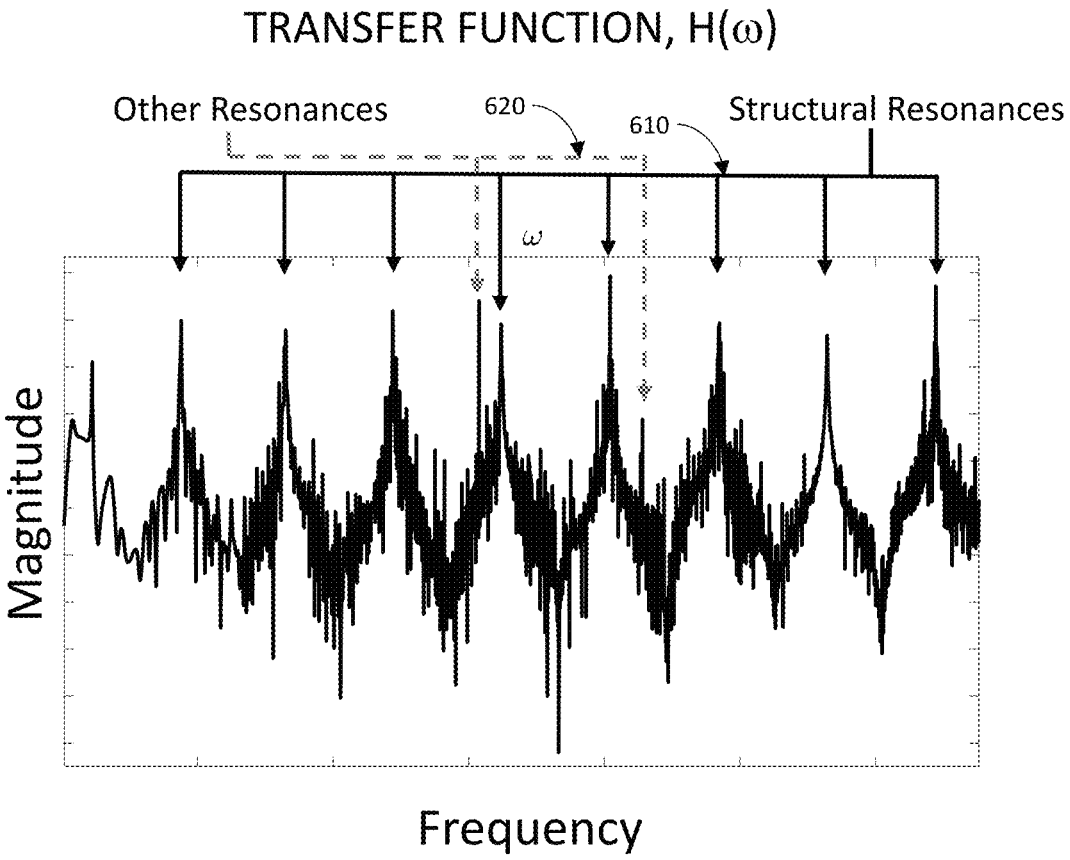
FIG. 6 is a plot of an example transfer function according to an implementation of the present disclosure.

FIG. 6 graphically depicts an example of a transfer function, H(ω). The transfer function includes a plurality of peaks 610, 620. The peaks correspond to mechanical resonances of the drill system that result from the perturbation caused by the prescribed input signal. The peaks include structural resonances 610 resulting from the mechanical response of the drill string and bit-rock interaction resonances 620 resulting from the mechanical response of the formation.

After the transfer function is computed 340, the method (FIG. 3) includes distinguishing 360 resonances (i.e., structural resonances, bit-rock interaction resonances) in the transfer function. The operation of distinguishing includes identifying the structural resonances due to the drill string based on an estimate of the drill string's resonances that is estimated 350 using the geometry and trajectory of the drill string. Resonances in the transfer function that correspond (i.e., align) with the estimated resonances of the drill string are structural resonances, while resonances that do not correspond with the estimated drill string resonances are due to the formation (i.e., bit-rock interaction resonances).

Structural resonances of the drill string 610 depend on the components/tools comprising the drill string (i.e., the geometry of the drill string) and the trajectory of the drill string. An estimate of the structural resonance of the drill string may be computed using a variety of methods that are well known in the art. For example, the structural resonances may be computing using the transfer matrix approach. As the drill string changes trajectory or geometry (e.g., new components/tools added, removed, or replaced during drilling) the estimate may be updated.

After the bit-rock interaction resonances are distinguished (e.g., by removing structural resonances), the method (FIG. 3) includes determining 370 the properties of the formation. The determination may be accomplished using a variety of approaches. One approach models the bit-rock interface as a spring-damper, wherein the spring corresponds to the compliance of the formation to drill-bit motion and the damper corresponds to the damping of the fluid around the bit and in the formation. Further, because the prescribed input signal (i.e., perturbation) is imparted by the drill string's bottom hole assembly (i.e., the lower portion of the drill string including the drill bit), the entire system may be modeled as a mass-spring-damper system.

In a mass-spring-damper system, the peak resonance occurs at the natural frequency $$\omega_0 = \sqrt{\frac{k}{m}}$$

where m is the mass of the bottom hole assembly (BHA) and k is the computed spring constant of the bit-rock interaction. Thus, a knowledge of the natural frequency resonance (e.g., obtained via the transfer function) and the mass of the BHA (e.g., obtained based on the geometry of the drill string) may provide the spring constant of the bit-rock interaction.

For axial perturbations, the spring constant of the bit-rock interaction, k, can be related to the Young's Modulus of the formation via the following equation:

$$E = \frac{\sigma_z}{\epsilon_z} = \frac{\frac{F_{bit}}{A_{bit}}}{\frac{\Delta L}{L}} = \frac{F_{bit}}{A_{bit}k}$$

where $F_{bit}$ is the force exerted by the drill bit and $A_{bit}$ is the cross-sectional area of the drill-bit through which the force is exerted.

For torsional perturbations, then k can be related to the shear modulus of the formation via the following equation:

$$G = \frac{\sigma_{rz}}{\gamma_{rz}} = \frac{\tau_{bit}}{r_{bit}k}$$

where $\tau_{bit}$ is the shear stress of the drill-bit and $\gamma_{bit}$ is the shear strain of the drill-bit.

In summary, bit-rock interaction resonances and properties (e.g., geometry, dimensions, forces, mass, weight, etc.) of the drill-bit may be used to determine formation properties. The formation properties may include (but are not limited to) Young's modulus, shear modulus, and/or one or more components of a three-dimensional stiffness/compliance matrix.

Additional rock properties may be estimated from the determined formation properties. For example, an estimate of porosity may be inferred if compressive strength, Young's modulus, and shear modulus are known. In addition, other measurements may be combined with the determined formation properties to offer additional information. For example, if porosity is known from offset wells, then pore fluid composition of the formation may be estimated.

The properties of the formation may be determined repeatedly during wellbore construction. For example, the method of FIG. 3 may be repeated 380 to obtain a set of formation properties at positions 160*a*, 160*b*, 160*c*, 160*e*, 160*d*, 160*e* along the length of the wellbore. The repeated measurement of formation properties may be triggered in a variety of ways. For example, a user may manually trigger a measurement of the formation properties (e.g., via a user interface). In another example, the operating parameters of the drill string (e.g., speed/torque) may trigger a measurement. In another example, the properties of the formation at the bit-rock interface may cause a trigger signal or a trigger-signal protocol (e.g., a prescription of the number and/or times of measurements). In still another example, the repeated measurements of formation properties may occur automatically as part of a normal drilling protocol. Indeed, another advantage of the present disclosure is that the probing/sensing/measuring may be integrated with normal drilling operations.

Repeated measurements of formation properties along a wellbore during wellbore construction may provide feedback for subsequent operations. For example, determined formation properties may be used to improve drilling efficiency (e.g., by changing drill string operation) or to guide construction (e.g., to insure wellbore stability). In another example, the selection of a prescribed input signal for a measurement may be based on the knowledge of the formation properties from one or more previous measurements. In addition, the determined formation properties may be used for reservoir modeling, which in turn facilitate better estimates of recoverable hydrocarbon reserves and guide fluid-production management techniques.

It should be appreciated that the logical operations described herein with respect to the various figures may be implemented (i) as a sequence of computer implemented acts or program modules (i.e., software) running on a computing device (e.g., the computing device shown in FIG. 7), (ii) as interconnected machine logic circuits or circuit modules (i.e., hardware) within the computing device and/or (iii) a combination of software and hardware of the computing device. Thus, the logical operations discussed herein are not limited to any specific combination of hardware and software. The implementation is a matter of choice dependent on the performance and other requirements of the computing device. Accordingly, the logical operations described herein are referred to variously as operations, structural devices, acts, or modules. These operations, structural devices, acts, and modules may be implemented in software, in firmware, in special purpose digital logic, and any combination thereof. It should also be appreciated that more or fewer operations may be performed than shown in the figures and described herein. These operations may also be performed in a different order than those described herein.

Figure 7:
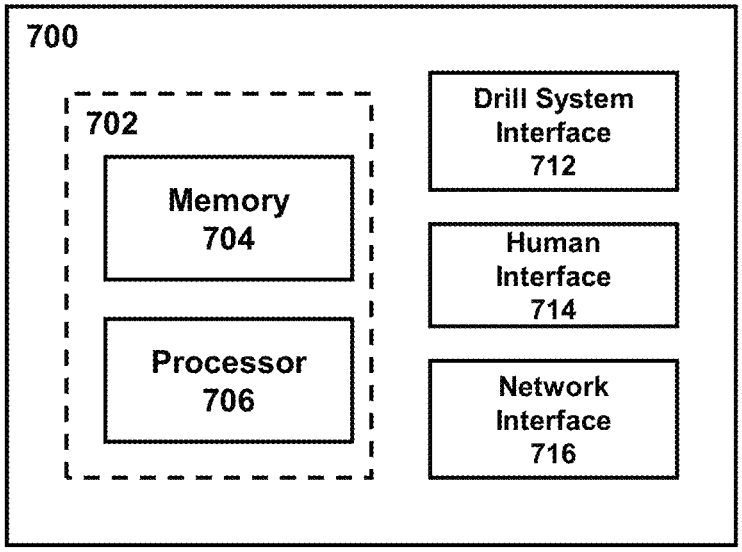
FIG. 7 schematically depicts a computing device according to an implementation of the present disclosure.

As shown in FIG. 7, the computing device 700 typically includes at least one processing unit 706 and system memory 704. Depending on the exact configuration and type of computing device, system memory 704 may be volatile (such as random access memory (RAM)), non-volatile (such as read-only memory (ROM), flash memory, etc.), or some combination of the two. This most basic configuration is illustrated in FIG. 7 by dashed line 702. The processing unit 706 may be a standard programmable processor that performs arithmetic and logic operations necessary for operation of the computing device 700 and the methods described herein.

The computing device 700 may include additional features/functionality. The computing device may include a human interface 714 that allows a human to interact with the components and operations described herein. The human interface may include software such as a graphical user interface (GUI) and/or hardware (e.g., keyboard, mouse, touch screen, display, speakers, printer, etc.). The computing device may include a drill interface system 712 that allows the computing device to transmit and receive information to/from the drill system components described previously. This communication may be wireless or wired using any analog or digital signals conforming to a number of protocols. The computing device may include a network interface to allow the computing device to communicate with other computing devices.

In the specification and/or figures, typical implementations have been disclosed. The present disclosure is not limited to such example implementations. The use of the term "and/or" includes any and all combinations of one or more of the associated listed items. The figures are schematic representations and so are not necessarily drawn to scale. Unless otherwise noted, specific terms have been used in a generic and descriptive sense and not for purposes of limitation.

The invention claimed is:

1. A method for determining properties of a formation during construction of a wellbore, the method comprising:

positioning a drill string in the wellbore so that a drill-bit of the drill string is in contact with the formation;

selecting, by a computing device, a prescribed input signal from among a plurality of different prescribed input signals, each of the plurality of different prescribed input signals being a deterministic or random signal, each of the plurality of different prescribed input signals having a varying amplitude and lasting for a fixed period, wherein the prescribed input signal acts through a motive-force source to induce a corresponding mechanical change in the drill string and wherein the prescribed input signal is selected based on one or more of the formation at an interface between the drill-bit and the formation, a particular drill string configuration, a signal to noise ratio (SNR) of the prescribed input signal, and easing/improving an estimation of mechanical harmonics of the drill string;

perturbing, for a period, one or more operating parameters of the drill-bit according to the selected prescribed input signal;

sensing, by the computing device, an output signal immediately following the period, wherein the output signal corresponds to the drill string's mechanical response to the perturbation;

converting, by the computing device, each of the selected prescribed input signal and the sensed output signal to a frequency domain;

determining, by the computing device, a transfer function based on the selected prescribed input signal and the sensed output signal, wherein the transfer function is a ratio of the sensed output signal to the selected prescribed input signal, each converted to the frequency domain, and wherein the transfer function is measured over a defined frequency range, said defined frequency range determined by the selected prescribed input signal; and analyzing, by the computing device, the transfer function to determine the properties of the formation, wherein the analysis includes distinguishing resonances in the transfer function as being resonances from the drill string or as being resonances from the formation.

2. The method according to claim 1, wherein the drill bit is perturbed while stationary or while drilling, and wherein the output signal represents both the drill string's mechanical response and the formation's mechanical response to the perturbing.

3. The method according to claim 1, wherein the one or more operating parameters of the drill-bit comprise one or more of a torque, a speed, a displacement, and an axial force.

4. The method according to claim 1, wherein the plurality of different prescribed input signals comprise a step input signal, a chirp signal, or a random white noise signal.

5. The method according to claim 4, wherein the selection is based on a desired transfer function characteristic.

6. The method according to claim 5, wherein the desired transfer function characteristic is a frequency, a bandwidth, or a resolution of the transfer function.

7. The method according to claim 1, further comprising:

repeating the operations of perturbing, sensing, computing, and analyzing during the construction of the wellbore so that the determined properties of the formation are from a plurality of positions in the wellbore.

8. The method according to claim 1, further comprising:

determining requirements for a stable wellbore or for hydraulic fracturing based on the determined properties of the formation.

9. The method according to claim 1, further comprising:

modeling a reservoir based on the determined properties of the formation.

10. The method of claim 1, wherein resonances from the formation and properties of the drill bit are used to create a model to determine the properties of the formation.

11. The method of claim 10, wherein the model comprises a mass-spring-damper model.

12. A drill system for wellbore construction, comprising:

a drill string comprising a drill-bit, wherein the drill-bit contacts a formation in the wellbore;

a motive-force source coupled to the drill string, wherein the motive-force source operates the drill-hit according to operating parameters;

one or more sensors coupled to the drill string, wherein the one or more sensors detect a mechanical response of the drill string; and a computing device comprising a processor in communication with the motive-force source and the one or more sensors, wherein the processor is configured by software instructions to:

select a prescribed input signal from among a plurality of different prescribed input signals, each of the plurality of different prescribed input signals being a deterministic or random signal, each of the plurality of different prescribed input signals having a varying amplitude and lasting for a fixed period, wherein the prescribed input signal is selected based on one or more of the formation at an interface between the drill-bit and the formation, a particular drill string configuration, a signal to noise ratio (SNR) of the prescribed input signal, and easing/improving an estimation of mechanical harmonics of the drill string;

cause the motive-force source to perturb, for a period, one or more operating parameters of the drill-bit according to the selected prescribed input signal, receive an output signal from the one or more sensors immediately following the period, wherein the output signal corresponds to the drill string's mechanical response to the perturbation, converting each of the selected prescribed input signal and the output signal to a frequency domain;

compute a transfer function based on the prescribed input signal and the output signal, wherein the transfer function is a ratio of the output signal to the selected prescribed input signal, each converted to the frequency domain, and wherein the transfer function is measured over a defined frequency range, said defined frequency range determined by the selected prescribed input signal; and analyze the transfer function to determine properties of the formation, wherein the analysis includes distinguishing resonances in the transfer function as being resonances from the drill string or as being resonances from the formation.

13. The drill system according to claim 12, wherein the operating parameters comprise one or more of one or more of a torque, a speed, a displacement, and an axial force.

14. The drill system according to claim 12, wherein the one or more sensors comprise one or more accelerometers aligned with one or more directions.

15. The drill system according to claim 12, wherein the plurality of prescribed input signals comprise a step input signal, a chirp signal, or a random white noise signal.

16. The drill system according to claim 12, wherein the properties of the formation comprise one or more components of a three-dimensional stiffness/compliance matrix.

17. The drill system according to claim 12, wherein the processor is further configured by software instructions to:

change the operating parameters based on the determined properties of the formation.

18. A specialized tool for a drill string, the specialized tool comprising:

a motive-force source coupled to the drill string, wherein the motive-force source operates a drill-bit of the drill string according to operating parameters;

one or more sensors coupled to the drill string, wherein the one or more sensors detect a mechanical response of the drill string; and a computing device comprising a processor in communication with the motive-force source and the one or more sensors, wherein the processor is configured by software instructions to:

select a prescribed input signal from among a plurality of different prescribed input signals, each of the plurality of different prescribed input signals being a deterministic or random signal, each of the plurality of different prescribed input signals having a varying amplitude and lasting for a fixed period, wherein the prescribed input signal is selected based on one or more of the formation at an interface between the drill-bit and the formation, a particular drill string configuration, a signal to noise ratio (SNR) of the prescribed input signal, and easing/improving an estimation of mechanical harmonics of the drill string;

cause the motive-force source to perturb, for a period, one or more operating parameters of the drill-bit according to the selected prescribed input signal, receive an output signal from the one or more sensors immediately following the period, wherein the output signal corresponds to the drill string's mechanical response to the perturbation, convert each of the selected prescribed input signal and the output signal to a frequency domain;

compute a transfer function based on the prescribed input signal and the output signal, wherein the transfer function is a ratio of the output signal to the selected prescribed input signal, each converted to the frequency domain, and wherein the transfer function is measured over a defined frequency range, said defined frequency range determined by the selected prescribed input signal, and analyze the transfer function to determine properties of the formation, wherein the analysis includes distinguishing resonances in the transfer function as from the drill string or as from the formation.

19. The specialized tool according to claim 18, wherein the specialized tool is a component of the drill string that is located within a wellbore during construction of the wellbore.

20. The specialized tool according to claim 19, wherein the specialized tool is communicatively coupled to a second computer at the surface of the wellbore during the construction of the wellbore.

* * * * *